US007866369B2

(12) United States Patent
Domolato

(10) Patent No.: US 7,866,369 B2
(45) Date of Patent: Jan. 11, 2011

(54) VERTICAL STRUCTURE CONTAINING A MOVABLE FRAME AND HAVING THE FUNCTIONS OF A SEAT AND/OR A PARTITION SCREEN

(76) Inventor: Maurizio Domolato, Via Olimpia, 8, Parma (IT) 43124

( * ) Notice: Subject to any disclaimer, the term of this patent is extended or adjusted under 35 U.S.C. 154(b) by 180 days.

(21) Appl. No.: 10/574,103

(22) PCT Filed: Sep. 30, 2004

(86) PCT No.: PCT/IT2004/000538

§ 371 (c)(1),
(2), (4) Date: Mar. 31, 2006

(87) PCT Pub. No.: WO2005/032306

PCT Pub. Date: Apr. 14, 2005

(65) Prior Publication Data

US 2007/0007403 A1 Jan. 11, 2007

(30) Foreign Application Priority Data

Oct. 3, 2003 (IT) ..... PR20030013 U

(51) Int. Cl.
*A47G 5/00* (2006.01)
*A47G 23/02* (2006.01)

(52) U.S. Cl. ..... 160/351; 248/146

(58) Field of Classification Search ..... 160/127, 160/128, 129, 135, 327, 350, 351, 353, 371, 160/377, 87; 297/14, 17, 118, 129, 130; 248/146; 135/95, 900, 901
See application file for complete search history.

(56) References Cited

U.S. PATENT DOCUMENTS

| | | | | | |
|---|---|---|---|---|---|
| 1,162,540 | A * | 11/1915 | Adams | 297/377 |
| 4,208,070 | A * | 6/1980 | Geschwender | 297/118 |
| 4,323,260 | A * | 4/1982 | Suchy | 280/47.25 |
| 4,703,944 | A * | 11/1987 | Higson | 280/30 |
| 5,655,459 | A * | 8/1997 | O'Connor et al. | 108/48 |
| 6,000,713 | A * | 12/1999 | Lin | 280/647 |
| 6,161,320 | A * | 12/2000 | Peterson | 40/605 |
| 6,663,174 | B2 * | 12/2003 | Drage et al. | 297/112 |
| 6,722,732 | B1 * | 4/2004 | Menne | 297/129 |
| 2003/0121123 | A1 * | 7/2003 | Ehrenreich | 16/197 |

FOREIGN PATENT DOCUMENTS

| | | | |
|---|---|---|---|
| DE | 42 33 398 | | 4/1994 |
| DE | 4233398 | A1 * | 4/1994 |
| DE | 295 01 720 | | 3/1995 |
| DE | 29501720 | * | 3/1995 |
| DE | 29501720 | U * | 3/1995 |
| FR | 671144 | B * | 9/1929 |
| FR | 671 144 | | 12/1929 |
| WO | WO 2004/019730 | | 3/1994 |
| WO | WO2004019730AA1 | * | 3/2004 |

* cited by examiner

*Primary Examiner*—David M Purol
*Assistant Examiner*—Jeremy C Ramsey
(74) *Attorney, Agent, or Firm*—Young & Thompson

(57) ABSTRACT

The present invention relates to a vertical structure containing a movable panel, which can become a comfortable seat, when needed. A plurality of such structures, in side-by-side relationship, create a useful space divider and/or partition screen.

14 Claims, 2 Drawing Sheets

3
3
3

VERTICAL STRUCTURE CONTAINING A MOVABLE FRAME AND HAVING THE FUNCTIONS OF A SEAT AND/OR A PARTITION SCREEN

BACKGROUND OF THE INVENTION

Space divider screens are known to be currently made from various materials and with various processes.

Depending on specific requirements, there is a tendency for manufacturers to customize space divider screens for public places, corporations or exhibitions; this helps to enhance and optimize spaces, and reduce costs associated thereto, and to customize a desired advertising image by using divider screens.

In this connection, it shall be highlighted that many corporations have a preference for those novel arrangements which aim at optimizing space to the slightest detail.

In order to better enhance one of the main features of this invention, one of the most common public places will be considered herein, in which space division is of the utmost importance, for a variety of reasons: an airport.

In airports, the spaces available for transiting passengers are organized in every detail.

This is important both to control normal passenger flow and to allow them to have a nice stay while they wait in the airport.

SUMMARY OF THE INVENTION

The invention, that will be described in greater detail hereafter, has the aim of optimizing all available spaces in which multiple functions are to be provided.

For example, a space divider screen may form both a waiting room and possibly an advertising medium, thanks to the panel contained in the inventive structure.

The structure as claimed in the Patent DE 4233398 and DE 295501720 are known. This structure ascribe to folding seat in which in folding position the seat and the back are not coplanar and in a precise manner the seat folding on the back.

The structure described in the cited prior arts cannot be utilized as divider screens with images, since the seat folds on its back.

In the scope of the above mentioned purpose, the invention provides a light and sturdy vertical structure, having a panel therein, which can be used as a comfortable seat or as an advertising medium, when needed.

A further feature of the invention is that, by adjoining multiple inventive structures, a space divider screen may be obtained, e.g. forming a waiting room, and the advertising space is increased, as if it were distributed in a single large wall.

BRIEF DESCRIPTION OF THE DRAWINGS

Further characteristics and advantages will be more apparent from the description of a preferred, non limiting embodiment of the invention, which is described by way of example and without limitation with the help of the annexed drawings, in which.

DETAILED DESCRIPTION OF THE INVENTION

Figures 1, 2, 3:
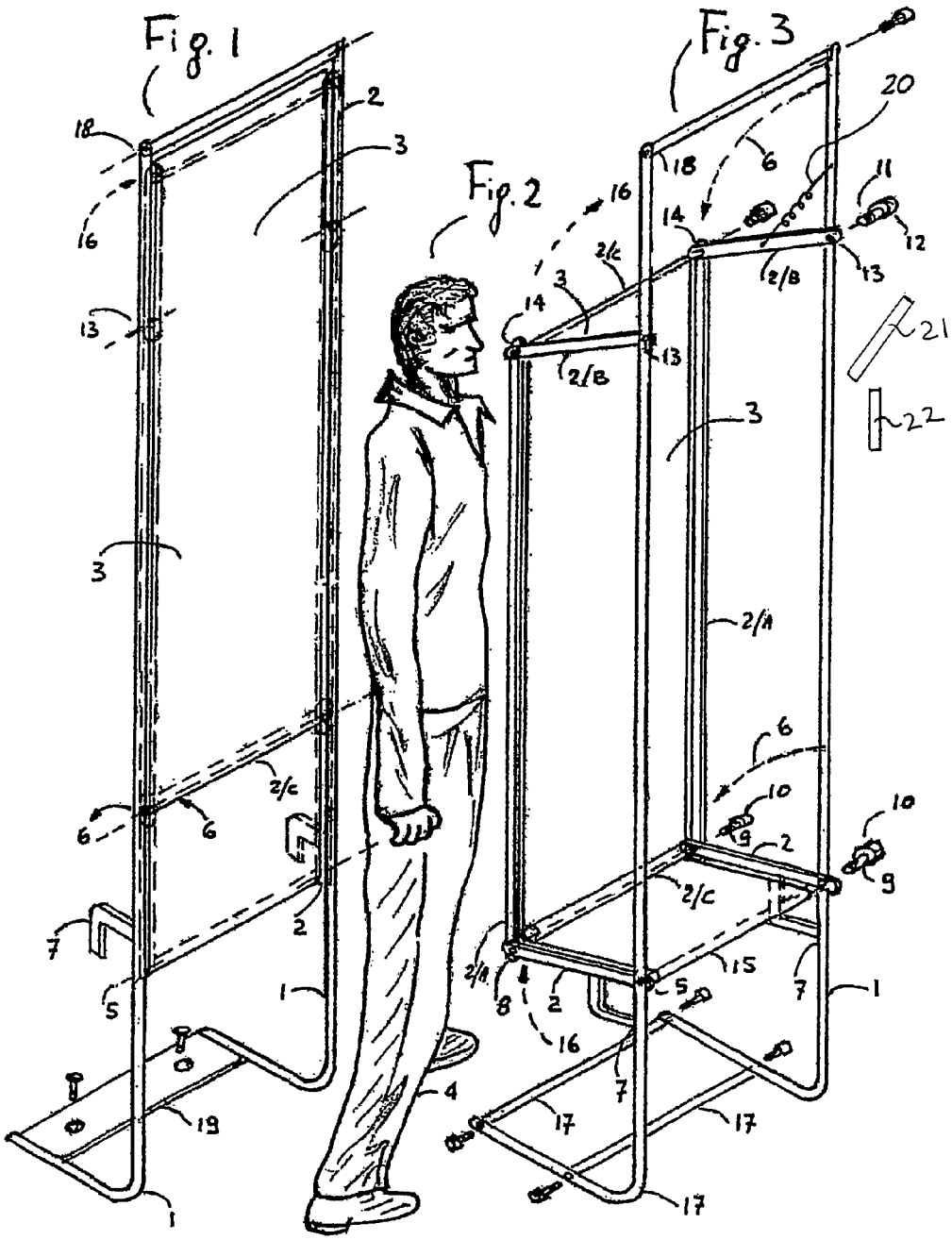
FIG. 1 is a schematic perspective view of the inventive assembly.
FIG. 2 is an exemplifying view of a tall man standing next to the inventive structure, to better show its space dividing function.
FIG. 3 is a schematic view of the inventive structure in its seat position.

Referring to the above figures, the present structure is generally shown in FIG. 1, which comprises an essentially vertical structure 1 having a frame, preferably made of metal, with an additional frame 2 mounted therein to receive a panel 3 made of a fabric, a synthetic material or else.

The vertical structure 1 is essentially made of upright poles or supports.

Figure 4:
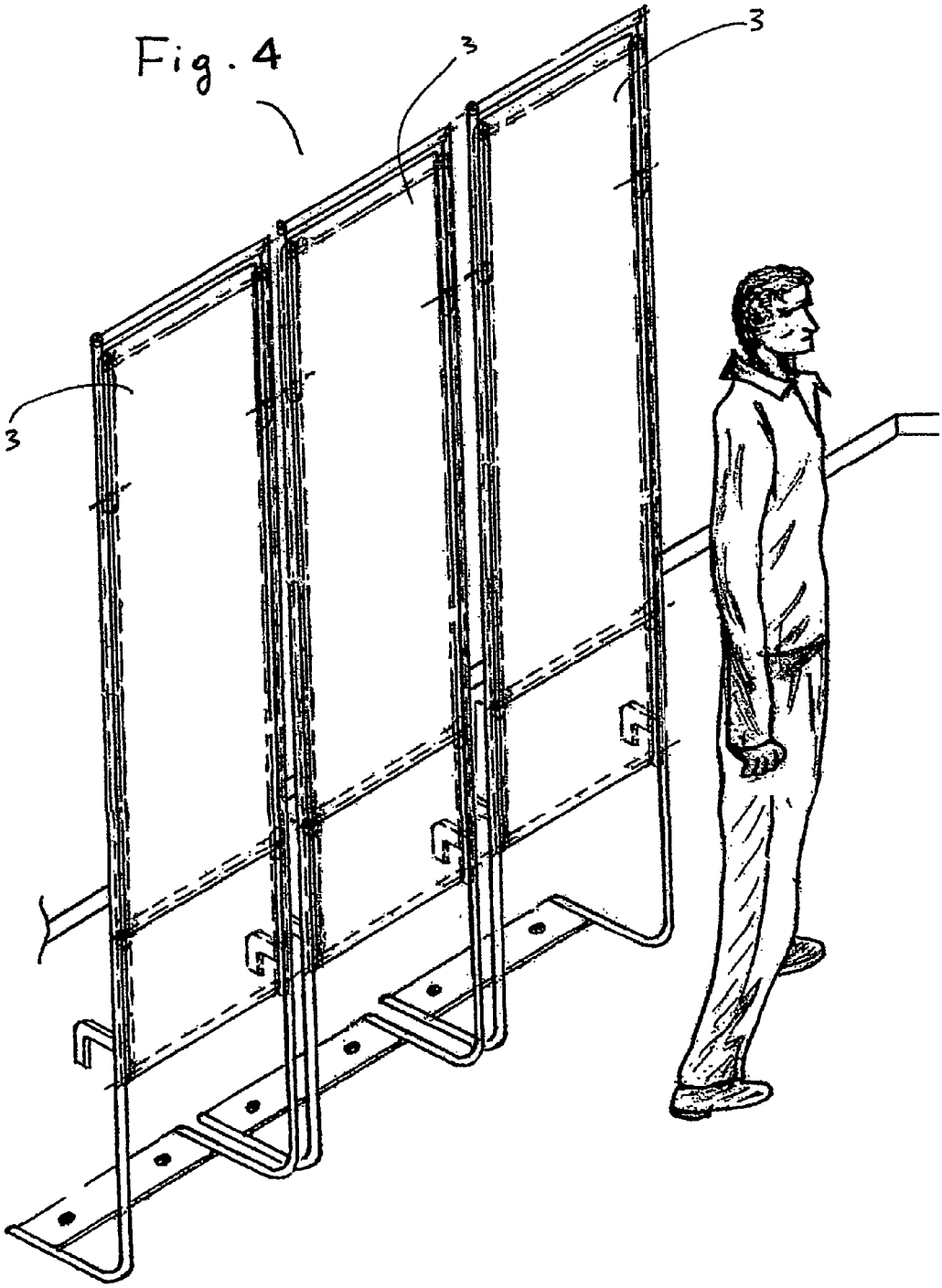
FIG. 4 is a schematic view of multiple structures according to the invention, which are placed in a side-by-side relationship to form a space divider and/or partition screen.

In FIG. 2, the size of a man 4 gives an idea of the height of the inventive structure, one of whose features is that of a space divider and/or partition screen, as better shown in FIG. 4.

In FIG. 3, the inventive structure is shown in its seat position.

This additional feature is simply obtained by manually pushing the cross member 2*c*, which is pivotally mounted to the inner frame through about 90° in the direction of arrow 6.

This simple operation, which turns the inventive structure into a comfortable seat, is achievable by providing that the frame received in the inventive structure is generally composed of lower rods 2*b* which are pivotally mounted by the shanks 9 of the screws 10 in the holes 5 and 8, the whole being joined by the stationary rod 15 which forms the bearing structure of the invention.

The motion of the upper portion of the inner frame of the inventive structure is simultaneously provided by the rods 2*a*, which are respectively connected beneath the rods 2, and above the rods 2*b*, the latter being in turn pivotally mounted to the shanks 11 of the screws 12 in the holes 13 and 14, the whole being joined by the cross member 2*c*, which is itself pivotally mounted to the frame.

The end of the stroke, i.e. the seat position, is obtained when the end stop 7 abuts against the structure 1.

Still referring to FIG. 3, it is apparent that the inventive structure may be simply brought back to the vertical position by an inverse motion, still through 90°, in the direction of arrow 16.

Cross members 17 and 18 are provided to complete the structure of the invention, which are mounted to the vertical rods that support the structure.

Back to FIG. 1, a plate 19 may be provided alternatively to crossbars 17, e.g. when that the whole inventive structure needs to be secured to the floor.

As well visible in FIG. 3, the seat moves through an angle of 90 degrees and reaches a vertical position and, at the same time, the panel 3 makes a rototraslation through an angle of 90 degrees, in the direction of arrow 16, to move to a coplanar position with the seat, as shown in FIG. 1.

Finally, the inventive structure is intended to be made of commonly available materials, which are susceptible of a number of variants, without altering the purpose thereof, e.g.: the return of the seat to its vertical position might be caused by a number of appropriately disposed return springs 20, or by hydraulic pistons (21) or balance weights (22) hidden in the vertical supports, or as extensions of the rods 2*d* of the frame 2.

Another example might be, for instance, the provision of a wholly disassembled kit of the inventive structure.

Also, all the details may be replaced by technically equivalent elements, and the materials may be actually different depending on different needs, provided their compatibility with specific usages.

The invention claimed is:

1. A vertical structure, having both functions of a seat and a partition screen, comprising:

a pair of upright supports (1);

a quadrilateral articulated frame (2) composed of rods (2*a*, 2*b*, 2*c*), a lower pair of the rods respectively hinged to the upright supports at a lower part of the upright supports, and an upper pair of the rods respectively hinged to the upright supports at an upper part of the upright supports; and an upper panel and a lower panel (3) attached the frame (2), said frame (2) being adapted to allow the vertical structure to act i) as a seat with the lower and the upper pairs of the rods (2*b*) of the frame (2) oriented perpendicular to the upright supports (1) and with the upper panel being a seat backrest and the lower panel being a seat bottom, and ii) as a partition screen with the lower and the upper pairs of rods (2*b*) and the upright supports coinciding and the upper panel (3) and the lower panel being coplanar, wherein the lower and the upper pairs of the rods (2*b*) of the frame are hinged to the upright supports (1) by pins (9, 11), wherein the pair of upright supports (1) remain vertical and non-displaced during operation of the structure while the frame is displace between a first configuration acting as the seat and a second configuration acting as the partition screen, and wherein said frame (2) is positioned with the lower and the upper pairs of the rods (2*b*) oriented perpendicular to the upright supports (1) and with the upper panel being a seat backrest and the lower panel being a seat bottom, the lower panel is accessible from a front and two sides by no further panels being attached between the rods of the frame other than said upper and lower panels.

2. A vertical structure as claimed in claim 1, wherein the frame (2) has end stops (7) mounted on the rods (2*b*), which abut against the upright supports when the seat position is reached.

3. A vertical structure as claimed in claim 1, further comprising:

return springs (20) provided between the frame (2) and the upright supports (1), disposed to cause the automatic return from the seat position to the partition screen position.

4. A vertical structure as claimed in claim 1, wherein balance weights hidden in the upright supports or as extensions of the rods (2*b*) of the frame (2) are disposed to cause the automatic return from the seat position to the partition screen position.

5. A vertical structure as claimed in claim 2, wherein lower pair of the rods (2*b*) is hinged with a stationary rod (15), the stationary rod connected traversely to the upright supports.

6. A vertical structure as claimed in claim 1, wherein the panel (3) is a single piece, which is secured between the rods (2*c*) and the stationary rod (15).

7. A vertical structure as claimed in claim 6, wherein the panel (3) is made of one selected from the group consisting of fabric, a synthetic material, and materials adapted to withstand the weight of a person.

8. A vertical structure as claimed in claim 1, wherein the upright supports are bent through an essentially right angle, and joined together by a plate (19) with elements for direct fastening thereof to the floor.

9. A vertical structure as claimed in claim 8, wherein the upright supports are straight and are configured to be fastened to the floor by one of anchor plates and flanges.

10. A vertical structure as claimed in claim 1, further comprising:

hydraulic pistons provided between the frame (2) and the frame (1) disposed to cause the automatic return from the seat position to the partition screen position.

11. The vertical structure of claim 1, wherein, with the vertical structure configured as a seat, i) the upper panel is vertical to the lower panel and ii) the upper panel is facing and completely spaced apart from the upright supports by the upper pair of the rods extending away from the upright supports and the lower pair of the rods extending away from the uprights supports.

12. A vertical structure, reconfigurable between a seat configuration and a partition screen configuration, comprising:

a pair of upright supports (1) extending in a first vertical position;

a quadrilateral articulated frame (2) composed of rods (2*a*, 2*b*, 2*c*), a lower pair of the rods respectively hinged to the upright supports at a lower part of the upright supports, and an upper pair of the rods respectively hinged to the upright supports at an upper part of the upright supports;

an upper panel (3) attached to an upper part of the frame (2);

a lower panel (3) attached to a lower part of the frame; and connection parts moving the frame, the upper panel, and the lower panel to between i) a first position, with the lower panel providing a seat, with the lower pair of the rods (2*b*) of the frame (2) oriented perpendicular to the upright supports (1) and with the upper panel being a seat backrest and the lower panel being a seat bottom, and the upright supports being in the first vertical position, and ii) a second position, with the upper panel and the lower panel both positioned vertically and providing a vertical partition screen, with a) the upper and lower pairs of the rods (2*b*) and the upright supports (1) being parallel, b) a first vertical plane defined by the upper panel (3) and a second vertical plane defined by the lower panel being coplanar, and c) the upright supports being in the first vertical position, wherein, in the first position, i) the upper panel is vertical to the lower panel, and ii) the upper panel is facing and completely spaced apart from the upright supports by the upper pair of the rods extending away from the upright supports and the lower pair of the rods extending away from the uprights supports, and iii) four connecting edges of the lower panel define a closed rectangle, the upper panel defines a first vertical side extending up from a first edge of the lower panel, and the other three edges of the lower panel provide free access to the lower panel as the seat bottom by the rods of the frame being free of any panels other than said upper and lower panels.

13. A vertical structure, having both functions of a seat and a partition screen, comprising:

a pair of upright supports (1);

a quadrilateral articulated frame (2) composed of rods (2*a*, 2*b*, 2*c*), a lower pair of the rods respectively hinged to the upright supports at a lower part of the upright supports, and an upper pair of the rods respectively hinged to the upright supports at an upper part of the upright supports; and an upper panel and a lower panel (3) attached the frame (2), said frame (2) being adapted to allow the vertical structure to act i) as a seat with the lower and the upper pairs of the rods (2*b*) of the frame (2) oriented perpendicular to the upright supports (1) and with the upper panel being a seat backrest and the lower panel being a seat bottom, and ii) as a partition screen with the lower and the upper pairs of rods (2*b*) and the upright supports coinciding and the upper panel (3) and the lower panel being coplanar, wherein four connecting edges of the lower panel define a closed rectangle, the upper panel defines a first vertical side extending up from a first edge of the lower panel, and the other three edges of the lower panel provide free access to the lower panel as the seat bottom by the rods of the frame being free of any panels other than said upper and lower panels.

14. A vertical structure as claimed in claim 12, wherein said frame (2) is positioned with the lower and the upper pairs of the rods (2*b*) oriented perpendicular to the upright supports (1) and with the upper panel being a seat backrest and the lower panel being a seat bottom, the lower panel is accessible from a front and two sides by no further panels being attached between the rods of the frame other than said upper and lower panels.

* * * * *